US012116782B2

(12) United States Patent
Steinberg et al.

(10) Patent No.: US 12,116,782 B2
(45) Date of Patent: Oct. 15, 2024

(54) PRE-ASSEMBLED DECKING PANEL AND STRUT ASSEMBLY FOR DATA CENTER CEILINGS AND ROOFS

(71) Applicant: TATE ACCESS FLOORS, INC., Jessup, MD (US)

(72) Inventors: Benjamin Lee Steinberg, Baltimore, MD (US); Daniel Brent Kennedy, Lovettsville, VA (US); Daniel Joseph Curtin, Dublin (IE)

(73) Assignee: TATE ACCESS FLOORS, INC., Jessup, MD (US)

( * ) Notice: Subject to any disclaimer, the term of this patent is extended or adjusted under 35 U.S.C. 154(b) by 0 days.

(21) Appl. No.: 17/880,974

(22) Filed: Aug. 4, 2022

(65) Prior Publication Data

US 2024/0044142 A1 Feb. 8, 2024

(51) Int. Cl.

| | |
|---|---|
| ***E04D 13/16*** | (2006.01) |
| ***E04B 9/18*** | (2006.01) |
| ***E04B 9/22*** | (2006.01) |
| ***E04C 2/08*** | (2006.01) |
| ***E04C 2/32*** | (2006.01) |
| ***E04C 2/38*** | (2006.01) |
| ***E04D 3/36*** | (2006.01) |
| ***E04D 11/02*** | (2006.01) |
| *E04C 2/00* | (2006.01) |

(52) U.S. Cl.

CPC ..... *E04D 13/1643* (2013.01); *E04B 9/18* (2013.01); *E04B 9/225* (2013.01); *E04C 2/08* (2013.01); *E04C 2/322* (2013.01); *E04C 2/38* (2013.01); *E04D 3/3603* (2013.01); *E04D 11/02* (2013.01); *E04B 2103/06* (2013.01); *E04C 2002/001* (2013.01)

(58) Field of Classification Search

CPC ..... E04B 9/18; E04B 9/22; E04B 2103/06; E04C 2/08; E04C 2/38; E04C 2/322; E04D 3/3603; E04D 11/02; E04D 13/1643

See application file for complete search history.

(56) References Cited

U.S. PATENT DOCUMENTS 407,376 A * 7/1889 Smith ..... A47K 3/284 52/341
1,948,619 A * 2/1934 Knutson ..... E04C 2/322 52/537
2,887,192 A * 5/1959 Blaski ..... E04D 3/3606 52/506.1

(Continued)

FOREIGN PATENT DOCUMENTS

CA 2794462 A1 * 1/2006
DE 10320896 A1 * 12/2004 ..... E04D 13/1643

(Continued)

*Primary Examiner* — Jessie T Fonseca
(74) *Attorney, Agent, or Firm* — Oliff PLC

(57) ABSTRACT

A pre-assembled decking panel and strut assembly for data center ceilings and roofs including a decking panel that is a sheet metal in a shape of a wave and an elongated strut member configured such that hanging systems can be attached to the elongated strut member. The peaks and valleys of the decking panel and the strut member extend in a first direction and are spaced in parallel in a second direction perpendicular to the first direction. A top wall of the strut member is affixed to a peak of the decking panel.

6 Claims, 7 Drawing Sheets

(56) References Cited

U.S. PATENT DOCUMENTS 3,466,222 A * 9/1969 Curtis ..... E04D 11/02 428/921
3,667,185 A * 6/1972 Maurer ..... E04D 3/24 D25/123
3,769,774 A * 11/1973 Barnes ..... F16L 3/14 52/39
3,843,080 A * 10/1974 Imai ..... F16B 37/041 411/360
4,382,353 A * 5/1983 Kelly ..... E04D 11/02 52/410
4,441,295 A * 4/1984 Kelly ..... E04D 13/1625 52/410
4,554,773 A * 11/1985 Conley ..... E04D 3/365 52/63
4,747,247 A * 5/1988 Petersen, Jr. ..... E04D 11/02 52/404.1
4,833,841 A * 5/1989 Ellington, III ..... E04B 1/3483 52/690
5,144,782 A * 9/1992 Paquette ..... E04D 13/1687 52/14
5,317,852 A * 6/1994 Howland ..... E04D 11/02 52/302.1
5,423,507 A * 6/1995 Florent ..... E04B 9/18 52/39
5,479,753 A * 1/1996 Williams ..... E04D 5/142 52/411
5,740,647 A * 4/1998 Kelly ..... E04D 11/02 52/410
6,634,151 B1 * 10/2003 Roth ..... E04C 5/18 52/700
7,603,814 B1 * 10/2009 Hartmann ..... G09F 7/18 52/27
7,854,421 B2 * 12/2010 Florent ..... F16L 3/243 248/300
9,850,659 B2 * 12/2017 Roth ..... F16B 2/065
11,168,719 B2 * 11/2021 Bodwell ..... E04B 1/003
11,598,092 B1 * 3/2023 Roth ..... F16M 13/02
2009/0000246 A1 * 1/2009 Chang ..... E04C 2/36 52/783.11
2010/0126093 A1 * 5/2010 Davis ..... E04B 1/3205 52/537
2011/0174951 A1 * 7/2011 Sander, Jr. ..... E04B 9/18 248/339
2016/0201346 A1 * 7/2016 Nunley ..... E04G 23/0218 52/745.21
2016/0290557 A1 * 10/2016 Roth ..... F16B 2/04
2016/0333584 A1 * 11/2016 Bogh ..... E04D 3/362
2019/0077700 A1 * 3/2019 Xu ..... B32B 5/022
2019/0352911 A1 * 11/2019 Kelly ..... E04D 3/30

FOREIGN PATENT DOCUMENTS

DE 102009005823 A1 * 7/2010 ..... E04D 13/1643
GB 2182369 A * 5/1987 ..... E04B 9/18
GB 2192649 A * 1/1988 ..... E04B 5/40
GB 2252806 A * 8/1992 ..... E04B 9/18
GB 2448383 A * 10/2008 ..... E04B 9/18
JP H0518055 A * 1/1993
JP H05222793 A * 8/1993
JP H06129051 A * 5/1994
JP H0782821 A * 3/1995
JP H0996056 A * 4/1997
JP H09184232 A * 7/1997
JP H1018502 A * 1/1998
JP 2000154607 A * 6/2000
WO WO-2017187342 A1 * 11/2017
WO WO-2020016093 A1 * 1/2020 ..... E04B 1/4121

* cited by examiner

PRE-ASSEMBLED DECKING PANEL AND STRUT ASSEMBLY FOR DATA CENTER CEILINGS AND ROOFS

FIELD OF THE INVENTION

This invention relates to data center ceilings and roofs. More particularly, this invention relates to decking panels of data center ceilings and roofs and the support hardware of those data center ceilings and roofs to which hanging systems can be attached or "hung."

BACKGROUND OF THE INVENTION

Data center ceilings and roofs typically include a decking between a joist and an upper insulation assembly or concrete deck.

More specifically, a joist is first installed as a component of a data center ceiling or roof. A decking is installed on the joist. Next, if a concrete ceiling or roof is desired, concrete is poured on the decking, with the decking functioning as a form for the concrete. If a concrete ceiling or roof is not desired, insulation and membrane layers that, in combination, form an upper insulation assembly, may be attached directly on top of the decking.

The decking typically includes a plurality of decking panels, arranged edge-to-edge, that are rolled steel sheets having a shape such that the joist and the upper insulation assembly or concrete deck are spaced apart by the decking, to provide space between the joist and the upper insulation assembly or concrete deck.

One example of a suitable shape of the rolled steel sheets is a wave shape.

When the decking is used as a form for the concrete poured on the decking, the concrete will usually fill at least some of space created by the decking. If, instead, an upper insulation assembly is attached to the decking, the decking may be perforated, and the space may be at least partially filled, through the perforations, by noise-absorbing batting.

Frequently, it is desired to "hang" a hanging system from a data center ceiling or roof. The hanging system may support components of an aisle containment system, racks for service items, air conditioning ducts, etc. In a typical data center ceiling or roof, spaced struts, beam clamps or other hanging system structural support hardware are attached to the joists. The hanging systems are attached to those spaced struts, beam clamps or other structural support hardware.

However, that installation process in the field—installing decking on the joists, either pouring concrete on the decking or installing an upper insulation layer on the decking, and then attaching spaced struts, beam clamps or other structural support hardware to the joists to support hanging systems—is time consuming, labor intensive and can lead to installation errors. Accordingly, there exists a need to simplify that installation process, while reducing the risk of installation errors.

The pre-assembled decking panel and strut assemblies of this invention address those needs, and other needs that are known to those of skill in the art.

SUMMARY OF THE INVENTION

The pre-assembled decking panel and strut assemblies for data center ceilings and roofs of some embodiments of this invention each include a decking panel and an elongated strut member configured such that hanging systems can be attached to, or "hung" from, the elongated strut member. The decking panel may be a sheet metal in a shape of a wave, with peaks and valleys that (1) extend longitudinally in a first direction and (2) are parallel. The peaks and valleys may be spaced in a second direction that is perpendicular to the first direction. The elongated strut member may extend in the first direction and may have a top wall in a third direction perpendicular to the first and second directions, when viewed from the first direction. The top wall may be attached to a first peak of the decking panel. The top wall and the first peak may include spaced mating holes configured to receive bolt assemblies.

In certain embodiments of this invention, the decking panel has a first end peak at a first end of the panel in the second direction and a second end peak at a second end of the decking panel in the second direction. The top wall of the first elongated strut member may be attached to the first end peak and the second end peak may be configured to be placed on and mate with the first end peak of an adjacent decking panel. The second end peak may include spaced bolt holes that match the mating holes in the first end peak and the elongated strut member.

In yet other embodiments of this invention, the first end peak may be above the top wall of the elongated strut member and the second end peak is configured to be above the first end peak of the adjacent decking panel when the decking panel having the second end peak and the adjacent decking panel are installed.

Data center ceilings and roofs that include the pre-assembled decking panel and strut assemblies of this invention have at least the following benefits and advantages over prior art data center ceilings and roofs.

First, the installation process is simplified. Indeed, an entire step in the installation process—adding spaced struts, beam clamps or other structural support hardware to the joists to support hanging systems—may be eliminated. Because of the inclusion of the elongated struts in the pre-assembled decking panel and strut assemblies of this invention, no additional hardware is necessary to support the hanging systems.

Second, because the junctions of adjacent decking panels are at the peaks of those panels, the risk of water penetration at those junctions is reduced. That is, water sometimes collects in the decking, and, specifically, at the low points or valleys of the decking panels. By having the junctions of the adjacent decking panels be at peaks of those panels, rather than valleys, the risk of water passing through the junctions is reduced.

Third, because the decking panel and strut assemblies are pre-assembled, the installation of such is simplified. The individual decking panel and strut assemblies are manufactured off-site, shipped to a data center and installed as a unit.

DETAILED DESCRIPTION OF EMBODIMENTS

Figure 1:
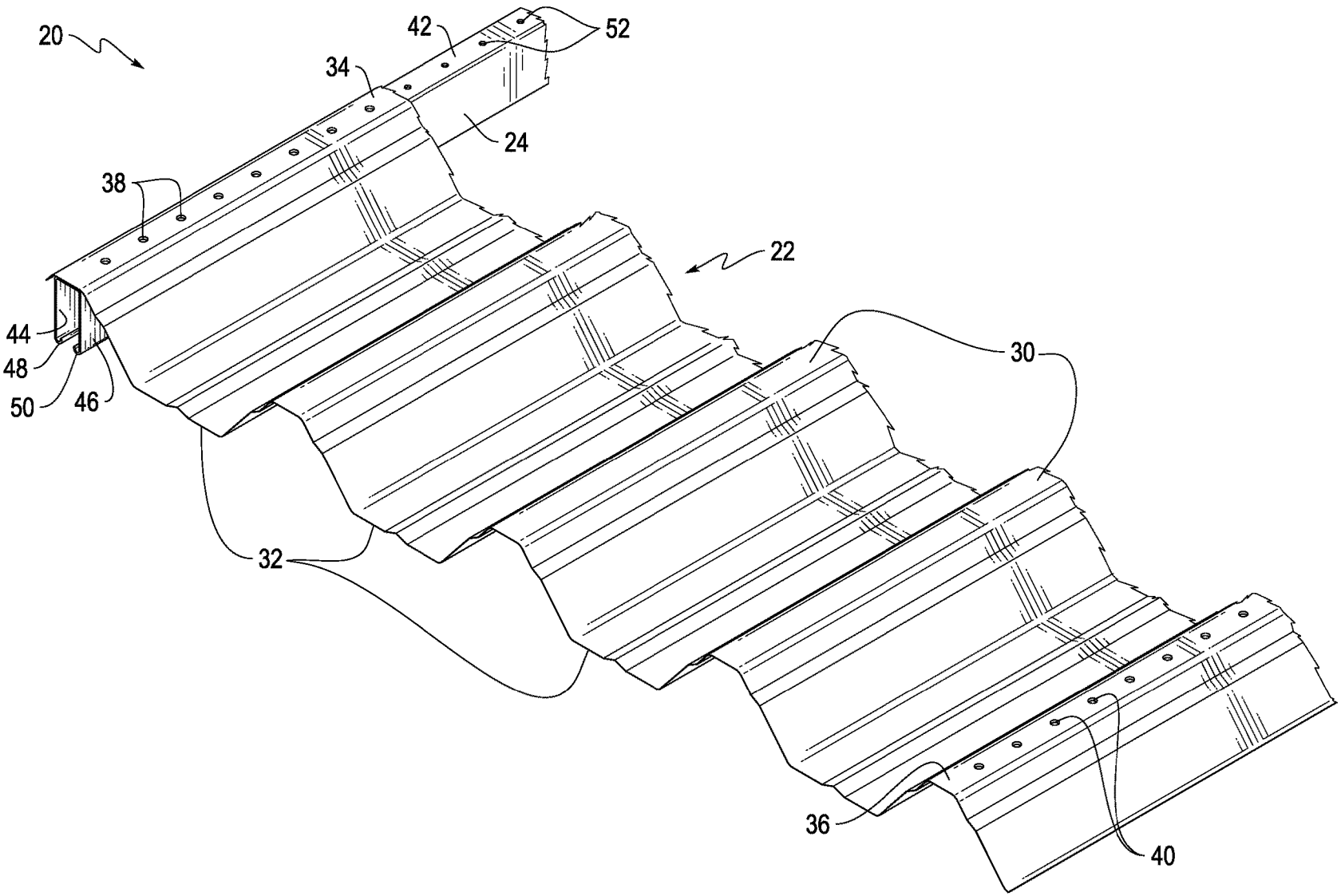
FIG. 1 is a top perspective view, partially sectionalized for clarity, of a pre-assembled decking panel and strut assembly of one embodiment of this invention.
Figure 2:
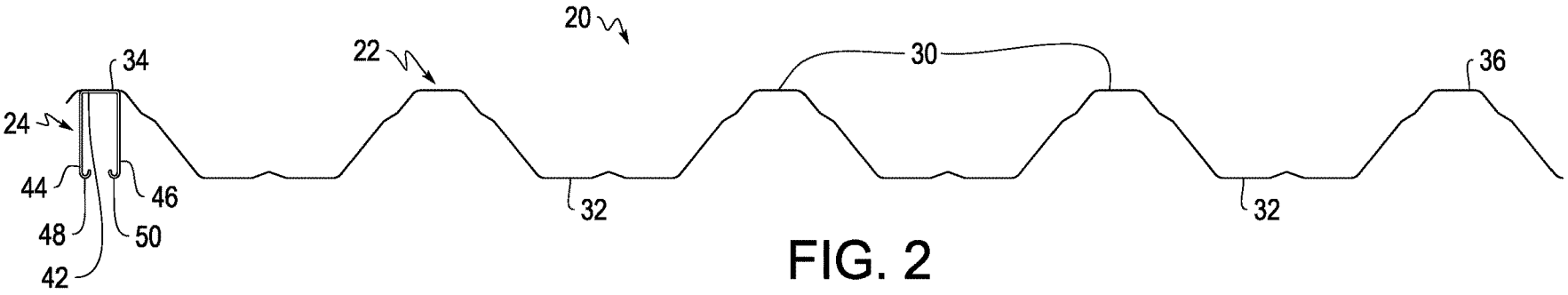
FIG. 2 is a front elevation view of the pre-assembled decking panel and strut assembly of the embodiment of this invention illustrated in FIG. 1.
Figure 3:
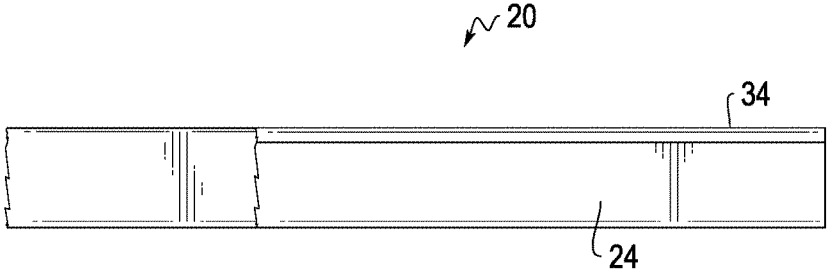
FIG. 3 is a side elevation view, partially sectionalized for clarity, of the pre-assembled decking panel and strut assembly of the embodiment of this invention illustrated in FIGS. 1 and 2.
Figure 4:
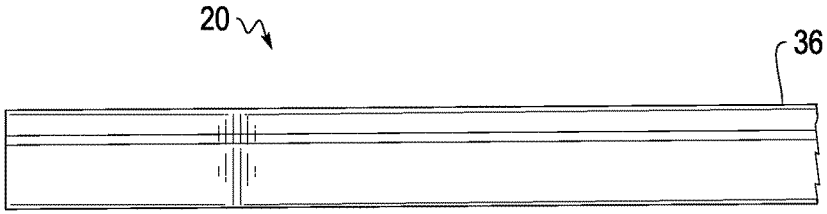
FIG. 4 is a side elevation view, partially sectionalized for clarity, of the pre-assembled decking panel and strut assembly of the embodiment of this invention illustrated in FIGS. 1-3, from the opposite side of the decking panel and strut assembly from FIG. 3.
Figure 5:
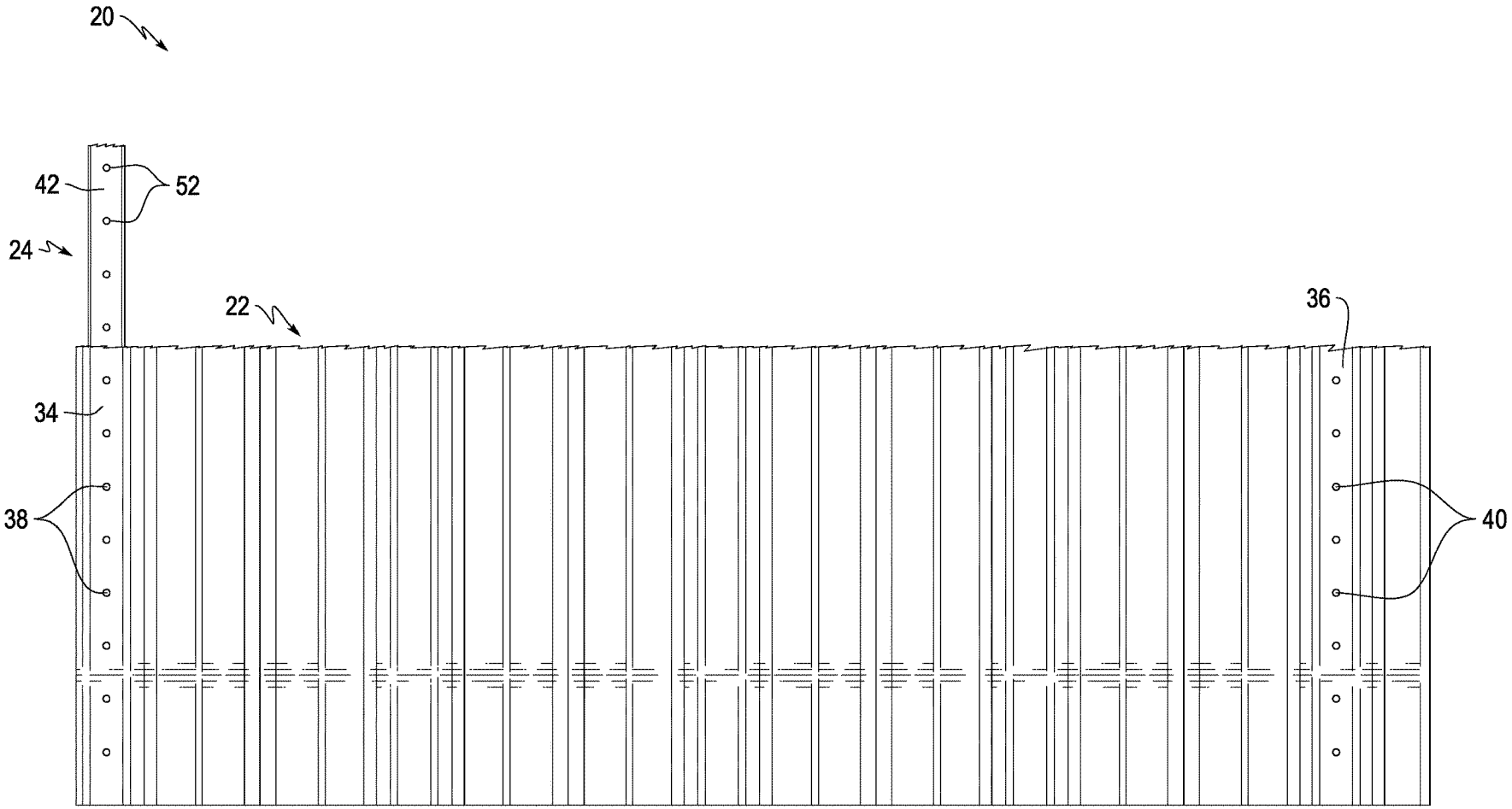
FIG. 5 is a top plan view, partially sectionalized for clarity, of the pre-assembled decking panel and strut assembly of the embodiment of this invention illustrated in FIGS. 1-4.
Figure 6:
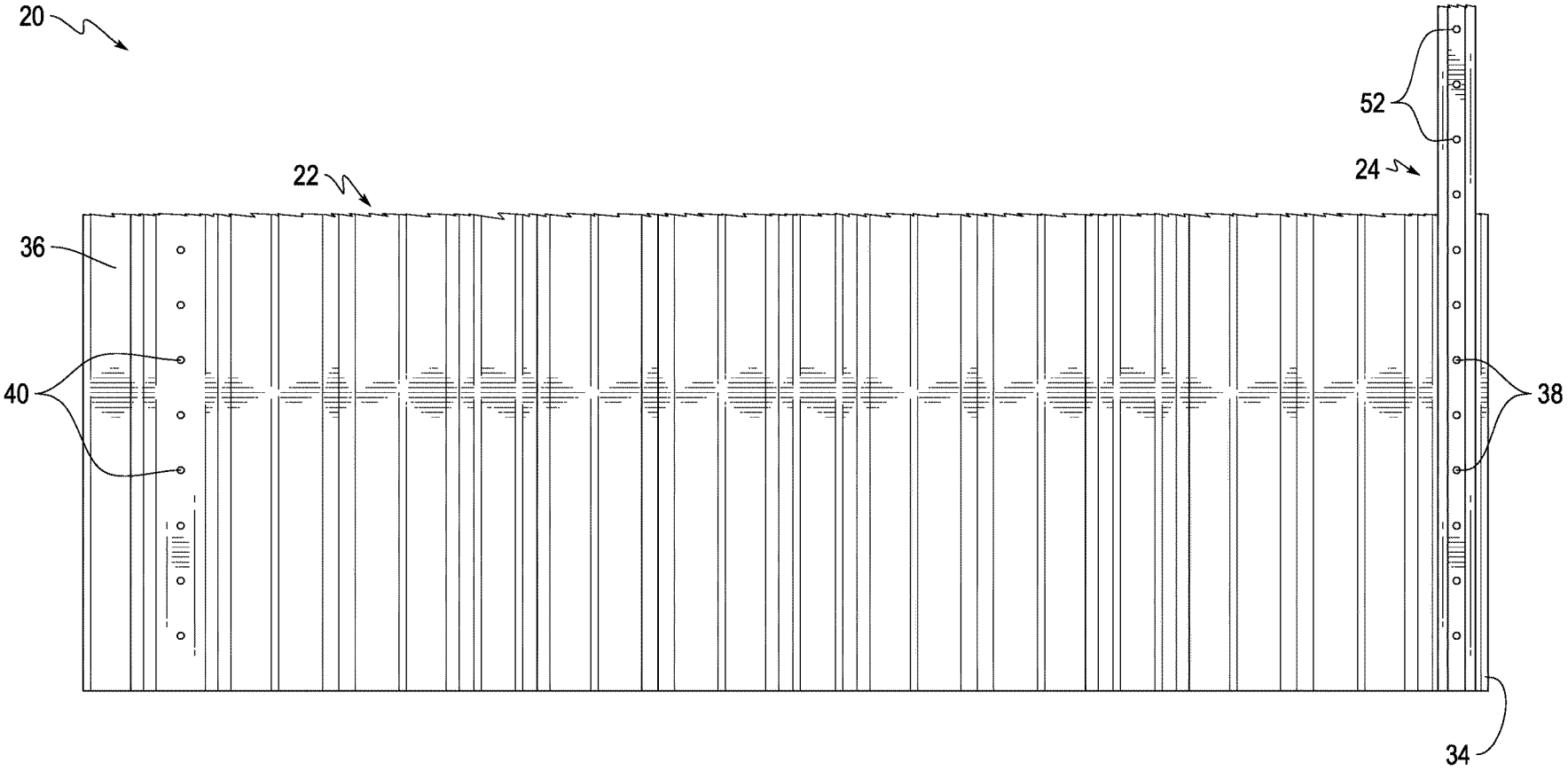
FIG. 6 is a bottom plan view, partially sectionalized for clarity, of the pre-assembled decking panel and strut assembly of the embodiment of this invention illustrated in FIGS. 1-5.
Figure 7:
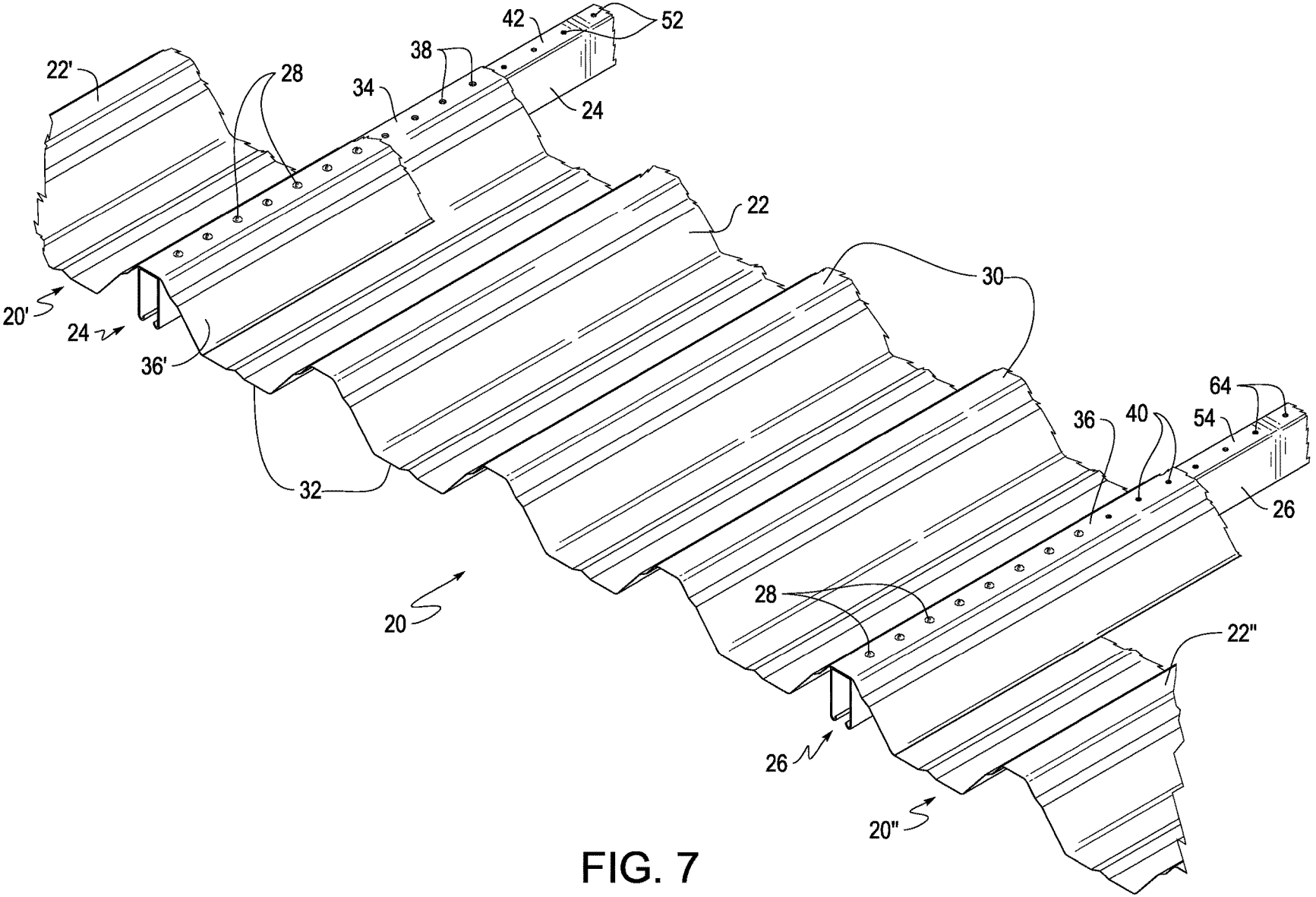
FIG. 7 is a top perspective view, partially sectionalized for clarity, of multiple decking panel and strut assemblies of the embodiment of this invention illustrated in FIGS. 1-6, assembled together.
Figure 8:
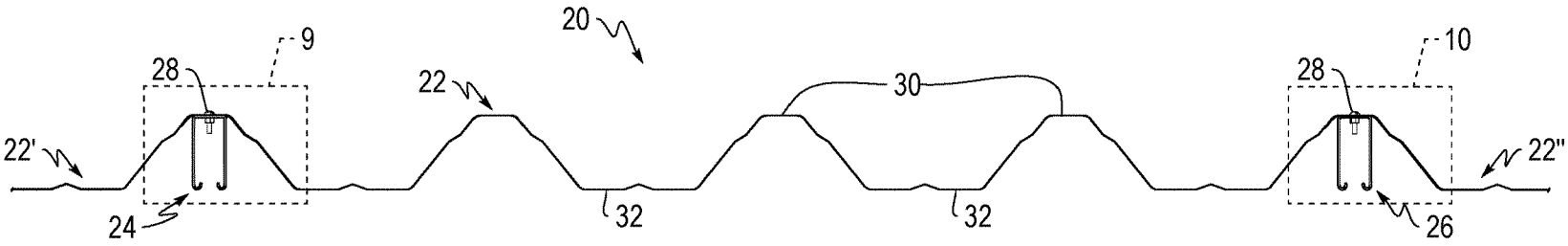
FIG. 8 is a front elevation view of the multiple decking panel and strut assemblies illustrated in FIG. 7, assembled together.

As stated, the pre-assembled decking panel and strut assembly of one embodiment of this invention is illustrated in FIGS. 1-6 and 13, decking panel and strut assembly 20. Decking panel and strut assembly 20 includes decking panel 22 and strut 24.

In this embodiment of the invention, decking panel 22 is a roll-formed steel sheet having a wave shape. One example of a wave shaped, roll-formed steel sheet that can be utilized as the decking panel in this embodiment of the invention is Joris Ide product number JI85-280-1120.

Decking panel 22 has parallel, alternating hills 30 and valleys 32. Hills 30 and valleys 32 extend in a first direction and alternate in a second direction that is perpendicular to the first direction. Hills 30 include partial end hill 34 and end hill 36 at the opposite ends of decking panel 22 in the second direction. Partial end hill 34 has spaced holes 38 in its top wall and end hill 36 has spaced holes 40 in its top wall.

While decking panel 22 has a wave shape, decking panels having other shapes can be utilized in the decking panel and strut assemblies of other embodiments of this invention as long as such panels provide the desired spacing and structural stability between the ceiling joist and the upper insulation assembly or concrete deck, as explained below. In addition, while decking panel 22 has partial end hill 34 and end hill 36 at its ends in the second direction, such ends of the decking panels of the decking panel and strut assemblies of other embodiments of this invention may have other shapes, as long as the ends can be sufficiently attached to struts, as also explained below.

Strut 24 includes top wall 42 and side walls 44 and 46, which extend downward from opposite edges of top wall 42. Side walls 44 and 46 include lower hook portions 48 and 50, respectively. Top wall 42 has spaced bolt holes 52.

While the decking panel and strut assembly of this embodiment of the invention includes strut 24 having the cross-sectional shape described above and illustrated in the figures, the struts of the decking panel and strut assemblies of other embodiments of this invention may have different cross-sectional shapes, as long as the struts having the different cross-sectional shapes can be joined to the decking panels and have sufficient structural strength and stability.

Figure 13:
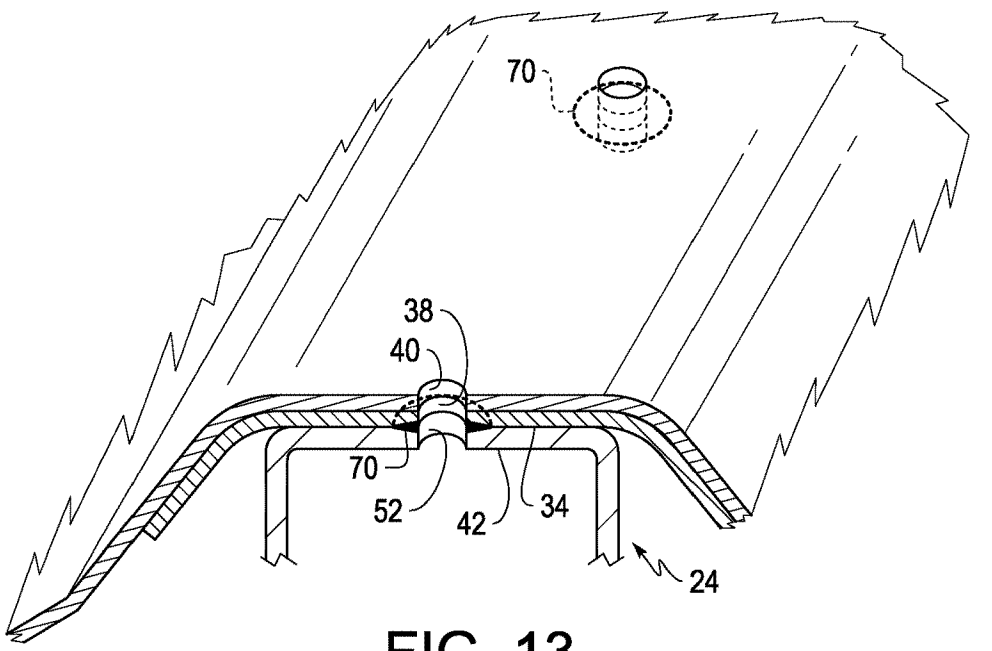
FIG. 13 is a top perspective view of portions of the decking panel and the elongated strut of the pre-assembled decking panel and strut assembly of the embodiment of this invention illustrated in FIGS. 1-6.
Figure 11:
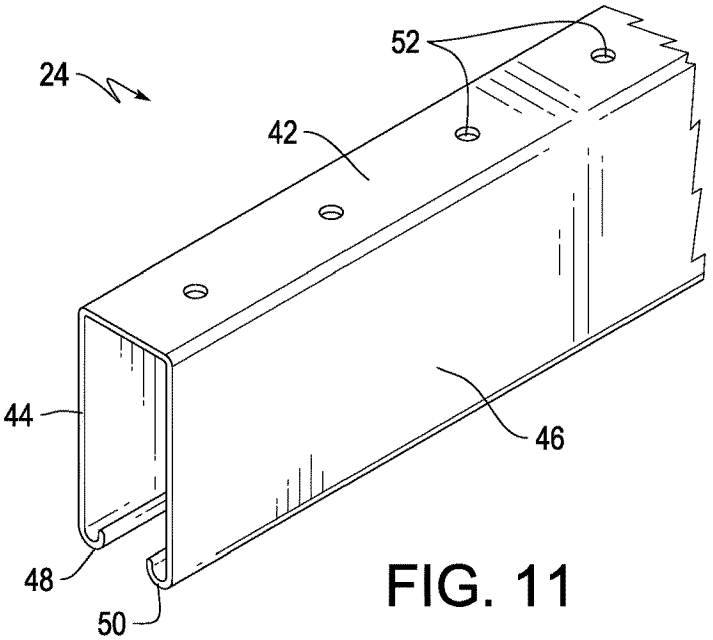
FIG. 11 is a top perspective view of a strut that can be used in the decking panel and strut assembly of the embodiment of this invention illustrated in FIGS. 1-6.

Top wall 42 of strut 24 is attached to partial end hill 34 by spot welding around bolt holes 52 of top wall 42 and spaced holes 38 in the top wall of partial end hill 34, as shown in FIG. 13.

Adjacent pre-assembled decking panel and strut assemblies 20 can be assembled as shown in FIGS. 7-10 and described below.

Specifically, the assembly of pre-assembled decking panel and strut assemblies 20, 20' and 20" is illustrated in FIGS. 7-10. Pre-assembled decking panel and strut assembly 20 includes, as stated, decking panel 22 and strut 24, pre-assembled decking panel and strut assembly 20' includes decking panel 22' and a strut (not shown) and pre-assembled decking panel and strut assembly 20" includes decking panel 22" and strut 26.

Decking panels 22' and 22" are the same as decking panel 22.

Similar to strut 24, strut 26 includes top wall 54 and side walls 56 and 58, which extend downward from opposite edges of top wall 54. Side walls 56 and 58 include lower hook portions 60 and 62, respectively. Top wall 54 has spaced bolt holes 64.

In the assembly of pre-assembled decking panel and strut assemblies 20, 20' and 20" illustrated in FIGS. 7-10, end hill 36' of decking panel 22' of pre-assembled decking panel and strut assembly 20' overlaps and is attached to the combination of partial end hill 34 of decking panel 22 and strut 24 of pre-assembled decking panel and strut assembly 20 by bolt assemblies 28. Similarly, end hill 36 of decking panel 22 of pre-assembled decking panel and strut assembly 20 overlaps and is attached to the combination of partial end hill 34" of decking panel 22" and strut 26 of pre-assembled decking panel and strut assembly 20" by bolt assemblies 28.

Figure 9:
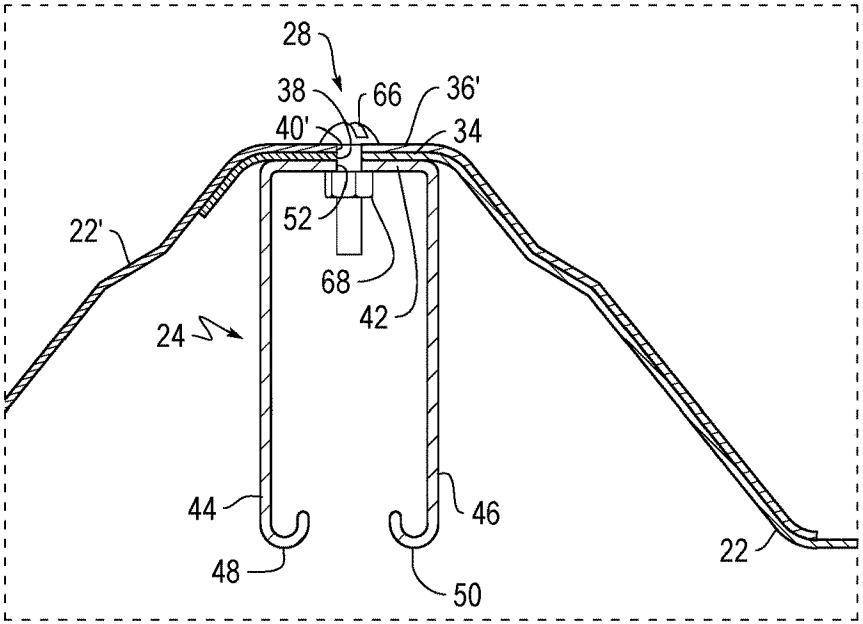
FIG. 9 is an enlarged view of the box labeled 9 in FIG. 8, showing the joinder of a strut and two decking panels of the multiple decking panel and strut assemblies.

More specifically, bolt assemblies 28 include bolts 66 and nuts 68. As shown in FIG. 9, holes 40' in end hill 36' of decking panel 22' of pre-assembled decking panel and strut assembly 20', holes 52 in top wall 42 of strut 24 of pre-assembled decking panel and strut assembly 20 and holes 38 in partial end hill 34 of decking panel 22 of pre-assembled decking panel and strut assembly 20 are aligned. Bolts 66 are inserted through those aligned holes, and nuts 68 are placed on those bolts and tightened.

Figure 10:
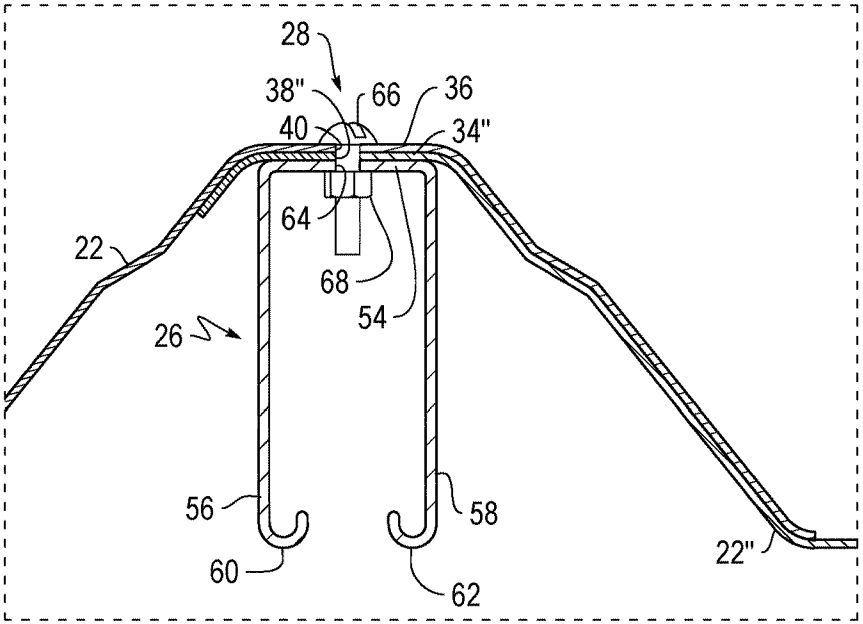
FIG. 10 is an enlarged view of the box labeled 10 in FIG. 8, showing another joinder of a strut and two decking panels of the multiple decking panel and strut assemblies.

Similarly, as shown in FIG. 10, holes 40 in end hill 36 of decking panel 22 of pre-assembled decking panel and strut assembly 20, holes 64 in top wall 54 of strut 26 of pre-assembled decking panel and strut assembly 22" and holes 38" in partial end hill 34" of decking panel 22" of pre-assembled decking panel and strut assembly 22" are aligned. Bolts 66 are inserted through those aligned holes, and nuts 68 are placed on those bolts and tightened.

In some embodiments of the pre-assembled decking panel and strut assemblies of this invention, nuts 68 can be fixedly attached to the underside of the walls 42 and 54 of struts 24 and 26 at holes 52 and 64, respectively, or holes 52 and 64 may be threaded holes with threads that mate with the threads of bolts 66, so that bolts 66 can be attached by simply rotating bolts 66, without having to separately support nuts 66.

As stated, the decking panel and strut assemblies of this invention can be pre-assembled off-site and then shipped to a data center for installation in the ceiling or roof of that data center. That pre-assembly results in the benefits and advantages discussed above.

Figure 12:
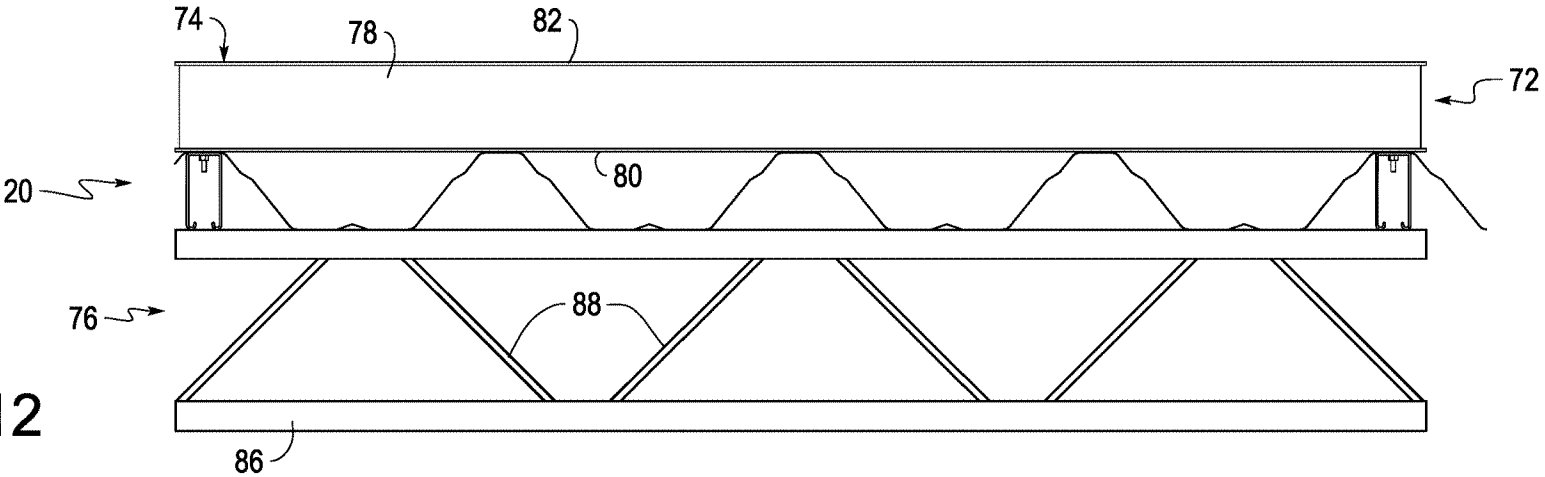
FIG. 12 is a front elevation view of a ceiling or roof assembly of a data center that includes the decking panel and strut assembly of the embodiment of this invention illustrated in FIGS. 1-6.

One application of this invention is illustrated in FIG. 12, ceiling or roof assembly 72. In this application, ceiling or roof assembly 72 includes outer or upper deck 74, a decking comprised of a plurality of decking panel and strut assemblies 20 and steel web joist 76.

Outer deck 74 includes insulation board 78, vapor layer 80 and outer membrane 82. In other applications, outer deck 74 can be a concrete deck or an additional concrete deck can be on top of outer deck 74.

Steel web joist 76, which is known as a high deck profile, includes top angles 84, bottom angles 86 and connecting rebars 88 which extend between and connect top angles 84 and bottom angles 86.

While this application includes steel web joist 76 having the configuration illustrated in FIG. 12 and described above, other configurations of a steel web joint can be used with the decking and strut assemblies of this invention, such as steel web joists including I-beams.

What is described and illustrated herein are preferred embodiments of the invention with some variations. The descriptions, figures and phraseology is intended to be for exemplary illustration only, and are not meant as limitations. Those skilled in the art will recognize that many embodiments and variations of the invention are possible, as the invention is defined by the following claims.

What is claimed is:

1. A pre-assembled decking panel and strut assembly for data center ceilings and roofs comprising:

a decking panel comprised of a sheet metal in a shape of a wave with peaks and valleys that (1) extend longitudinally in a first direction, (2) are parallel and (3) are spaced in a second direction that is perpendicular to the first direction; and an elongated strut member configured such that hanging systems can be attached to the elongated strut member, wherein:

the peaks are higher than the valleys in an up-down direction that is perpendicular to the first and second directions;

the elongated strut member (1) extends in the first direction and (2) has a top wall in the up-down direction, when viewed from the first direction;

the top wall is (i) fixedly and directly attached to a first peak of the peaks of the decking panel and (ii) below the first peak in the up-down direction;

the top wall and the first peak of the decking panel include spaced mating holes configured to receive bolt assemblies;

the decking panel has a first end peak of the peaks at a first end of the decking panel in the second direction that is the first peak and a second end peak of the peaks at a second end of the decking panel in the second direction;

the second end peak is configured to be placed on and mate with the first end peak of an adjacent one of the decking panel; and the second end peak includes spaced bolt holes that match the spaced mating holes in the first peak of the adjacent one of the decking panel and the top wall of the elongated strut member.

2. The pre-assembled decking panel and strut assembly according to claim 1, wherein:

the first end peak is above the top wall of the elongated strut member in the up-down direction; and the second end peak is configured to be above the first peak of the adjacent one of the decking panel in the up-down direction when the pre-assembled decking panel and strut assembly and the adjacent one of the decking panel are installed.

3. The pre-assembled decking panel and strut assembly according to claim 2, wherein:

the first end peak is a partial end peak with only one side wall continuous with a top wall of the first end peak; and the second end peak is a full end peak with two side walls continuous with opposite edges of a top wall of the second end peak.

4. The pre-assembled decking panel and strut assembly according to claim 3, wherein the top wall of the elongated strut member and the first peak of the decking panel are spot welded around the spaced mating holes.

5. A data center ceiling or roof comprising:

at least three pre-assembled decking panel and strut assemblies; and a plurality of bolt assemblies, wherein:

each of the pre-assembled panel and strut assemblies comprises:

a decking panel comprised of a sheet metal in a shape of a wave with peaks and valleys that (1) extend longitudinally in a first direction, (2) are parallel and (3) are spaced in a second direction that is perpendicular to the first direction; and an elongated strut member configured such that hanging systems can be attached to the elongated strut member;

the peaks are higher than the valleys in an up-down direction that is perpendicular to the first and second directions;

the elongated strut member (1) extends in the first direction and (2) has a top wall in the up-down direction, when viewed from the first direction;

the top wall is fixedly attached to a first peak of the peaks of the decking panel;

the top wall and the first peak of the decking panel include spaced mating holes configured to receive the plurality of bolt assemblies;

the decking panel has a first end peak of the peaks at a first end of the decking panel in the second direction that is the first peak and a second end peak of the peaks at a second end of the decking panel in the second direction;

the second end peak includes spaced bolt holes that match the spaced mating holes in the top wall of the elongated strut member and the first peak;

the elongated strut members of the at least three pre-assembled decking panel and strut assemblies are parallel and spaced in the second direction;

the second end peak of the decking panel of a first of the at least three pre-assembled decking panel and strut assemblies is attached to a combination of the first end peak of the decking panel and the strut member of a second of the at least three pre-assembled decking panel and strut assemblies by a first set of the plurality of bolt assemblies passing through the spaced bolt holes of the second end peak of the decking panel of the first of the at least three decking panel and strut assemblies and the spaced mating holes of the top wall of the elongated strut member and the first peak of the decking panel of the second of the at least three decking panel and strut assemblies; and the second end peak of the decking panel of the second of the at least three pre-assembled decking panel and strut assemblies is attached to a combination of the first end peak of the decking panel and the strut member of a third of the at least three pre-assembled decking panel and strut assemblies by a second set of the plurality of bolt assemblies passing through the spaced bolt holes of the second end peak of the decking panel of the second of the at least three decking panel and strut assemblies and the spaced mating holes of the top wall in the elongated strut member and the first end peak of the third of the at least three pre-assembled decking panel and the strut assemblies.

6. The data center ceiling or roof according to claim 5, wherein heads of bolts of the plurality of bolt assemblies are above the at least three pre-assembled decking panel and strut assemblies decking panels in the up-down direction and nuts of the plurality of bolt assemblies are below the top walls of the elongated strut members in the up-down direction.

* * * * *